US005495938A

United States Patent [19]

Bedford et al.

[11] Patent Number: 5,495,938

[45] Date of Patent: Mar. 5, 1996

[54] CONVERTIBLE DISPLAY CASE AND DESK ORGANIZER

[75] Inventors: Neville Bedford, Johnston, R.I.; Eduard U. Milea, Attleboro, Mass.

[73] Assignee: The Quill Company, Inc., Cranston, R.I.; a part interest

[21] Appl. No.: 371,281

[22] Filed: Jan. 11, 1995

[51] Int. Cl.[6] ..... A45C 11/34; B65D 85/26

[52] U.S. Cl. ..... 206/45.14; 206/214; 206/224; 206/371

[58] Field of Search ..... 206/45.14, 45.19, 206/44 R, 214, 579, 224, 371

[56] References Cited

U.S. PATENT DOCUMENTS

| | | | |
|---|---|---|---|
| 3,409,122 | 11/1968 | Hayes et al. . | |
| 4,807,744 | 2/1989 | Chiou | 206/214 |
| 4,964,519 | 10/1990 | Sugarman et al. | 206/214 X |
| 5,224,594 | 7/1993 | Hou | 206/371 X |

*Primary Examiner*—Jacob K. Ackun
*Attorney, Agent, or Firm*—Salter & Michaelson

[57] ABSTRACT

A convertible display case and desk organizer includes hingedly connected top and bottom sections pivotable with respect to another between closed position and opened positions. A first insert capable of releasably securing at least one writing instrument is releasably placed in the bottom section. The arrangement is such that, when the first insert is disposed within the bottom section, the top and bottom sections and first insert assume a display case mode. A second insert is releasably placed in the bottom section when the first insert is removed therefrom. The second insert has an outwardly extending portion which extends outwardly beyond the edge of the top and bottom sections when they are in their closed position. The outwardly extending portion has at least one aperture formed therein for receiving a writing instrument in a substantially upright position. The arrangement is such that, when said second insert is disposed within the bottom section, the top and bottom sections and the second insert assume a desk organizer mode.

8 Claims, 4 Drawing Sheets

CONVERTIBLE DISPLAY CASE AND DESK ORGANIZER

BACKGROUND AND SUMMARY OF THE INVENTION

This invention relates generally to display boxes and more particularly to a convertible display case and desk organizer for displaying and storing writing instruments.

This invention is in the same general field as U.S. Pat. No. 3,409,122 which discloses a pen and pencil desk set which may be used for displaying a pen and pencil set and as a desk organizer.

The instant invention provides an improved convertible display case and desk organizer construction of the general type comprising hingedly connected top and bottom sections pivotable with respect to another along respective long sides between a closed position and an open position. The top and bottom sections each have latching elements releasably interengageable with one another for maintaining the top and bottom sections in their closed position. The top section has an elongate viewing opening formed therein along the length of the top section for viewing the writing instrument when the top and bottom sections are in their closed position. A first insert capable of releasably securing at least one writing instrument thereto is releasably placed in the bottom section. When the top and bottom sections are in their closed position, the writing instrument secured to the first insert may be viewed through the viewing opening in the top section. The arrangement is such that, when the first insert is disposed within the bottom section, the top and bottom sections and first insert assume a display case mode. After the purchaser has removed the writing instrument and first insert from the case, a second insert is releasably placed in the bottom section, which second insert has an outwardly extending portion which extends outwardly beyond the edge of the top and bottom sections when they are in their closed position. The outwardly extending portion has at least one aperture formed therein for receiving a writing instrument in a substantially upright position. The arrangement is such that when said second insert is disposed within the bottom section, the top and bottom sections and the second insert assume a desk organizer mode. In its display case mode, the viewing opening is covered by an elongate, transparent window releasably attached to the top section wherein the transparent window protects the writing instrument while allowing it to be viewed. In its desk organizer mode, the viewing opening is covered by an elongate plate releasably attached to the top section wherein the plate carries information about its user or any other indicia thereon.

In a preferred embodiment, the top section has a downwardly sloping surface having the viewing opening formed therein. The first insert has an upper surface and an elongate recess formed in the upper surface for releasably securing a writing instrument therein. The second insert has support means on which additional writing instruments can be stored within the case when it is in its desk organizer mode. More particularly, the support means comprises at least two spaced-apart vertical walls having aligned upwardly opening notches for receiving the writing instrument longitudinally within the bottom section. The walls define separate compartments which are adapted to store other articles, such as paper clips and the like.

It has been found that the convertible display case and desk organizer of the instant invention has significant advantages over the heretofore available cases of this general type.

In particular, the case of the instant invention, in its preferred embodiment, is easily convertible between its display case mode and its desk organizer mode. Moreover, the viewing opening, which is covered by a transparent window in its display case mode, is adapted to receive a plate instead of the window for carrying information, such as the user's name, or any other indicia thereon when it is in its desk organizer mode. Also, when in its desk organizer mode, it has several separate compartments which are adapted to store other articles, such as paper clips and the like, therein.

Accordingly, among the several objects of the present invention are the provision of a new and improved convertible display case and desk organizer; the provision of such convertible display case and desk organizer which, in its display case mode, displays and stores articles, such as writing instruments, and in its desk organizer mode is used to secure the writing instrument in a substantially upright position; the provision of such a convertible display case and desk organizer capable of receiving a name plate thereon; the provision of such a convertible display case and desk organizer which, in its desk organizer mode, is capable of storing other articles, such as paper clips; and the provision of such a convertible display case and desk organizer which is simple in construction and easy to use.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
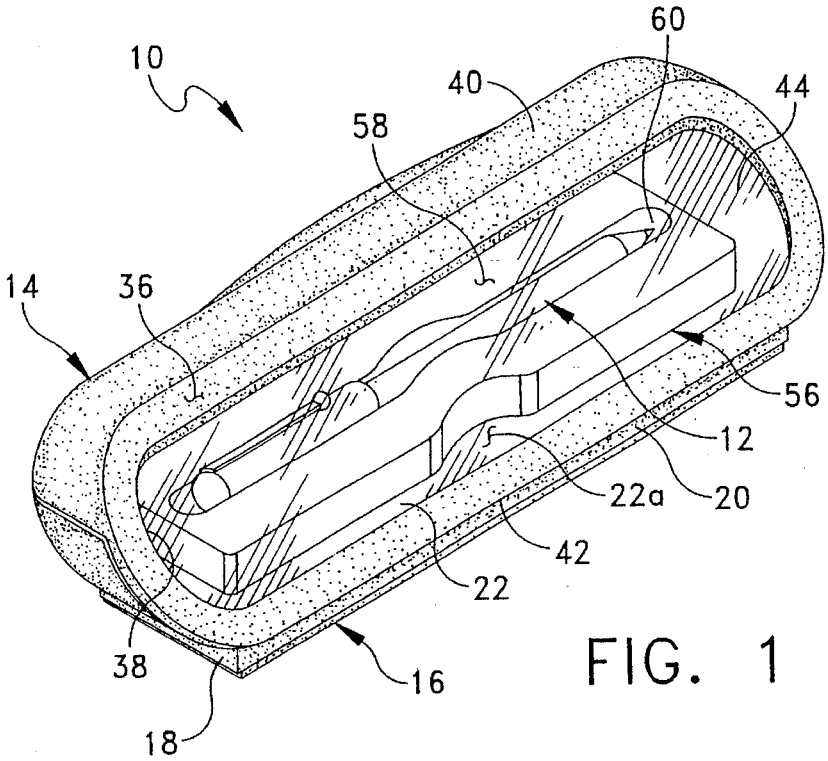
FIG. 1 is a perspective view of a convertible display case and desk organizer of the present invention in its display case mode.

Referring now to the drawings, and more particularly to FIG. 1, there is generally indicated at 10 a convertible display case and desk organizer of the present invention which is especially suited for displaying and storing articles, such as a writing instrument which is generally indicated at 12. The convertible display case and desk organizer 10 comprises hingedly connected top and bottom sections generally indicated at 14 and 16, respectively, which are preferably each integrally molded from a suitable plastic material. The convertible display case and desk organizer 10 is constructed so that the top and bottom sections 14, 16 are hingeable along respective long sides between a closed position illustrated in FIGS. 1 and 7 and an open position illustrated in FIGS. 2, 3, 5 and 6.

The bottom section 16 includes a base portion 18 having a downwardly extending peripheral wall 20 which forms a downwardly opening cavity 20*a* (FIG. 6) and a bottom wall 22 which has an upwardly facing, horizontal surface 22*a*, a straight side wall 24, and two curved end walls 26, 28 located at opposite ends of the side wall 24. The cavity 20 is sized for receiving a foam pad 30 therein which is designed to engage and protect the surface on which the convertible display case and desk organizer rests (e.g., a desk top). The bottom section 16 further includes a pair of spaced-apart hinge elements each indicated at 32 in the form of openings which are adapted to receive hinge elements each indicated at 34 of the top section 14 in the form of pins. It should be understood that any suitable hinging arrangement may be used for hingedly attaching the top and bottom sections 14, 16 and not just the hinge arrangement illustrated in the drawings.

The top section 14 includes a downwardly sloping surface 36 having an elongate viewing opening 38 formed therein, and a curved side wall 40 which is adapted to engage the straight side wall 24 of the bottom section 16 when the top section is in its closed position. An edge 42 of the top section 14 includes the spaced-apart hinge elements 34 in the form of pins which are inserted into the hinge elements 32 of the bottom section 16. As mentioned above, the top and bottom sections 14, 16 are pivotable with respect to each other along adjacent long sides between the closed position illustrated in FIGS. 1 and 7 and the open position illustrated in FIGS. 2, 3, 5 and 6.

Figure 6:
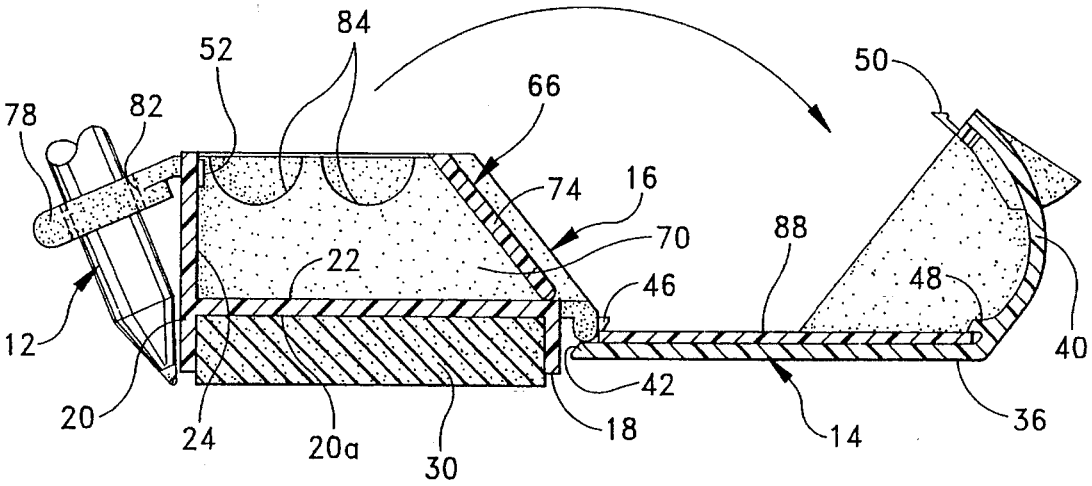
FIG. 6 is a cross-sectional view taken along line 6—6 of FIG. 5.
Figure 7:
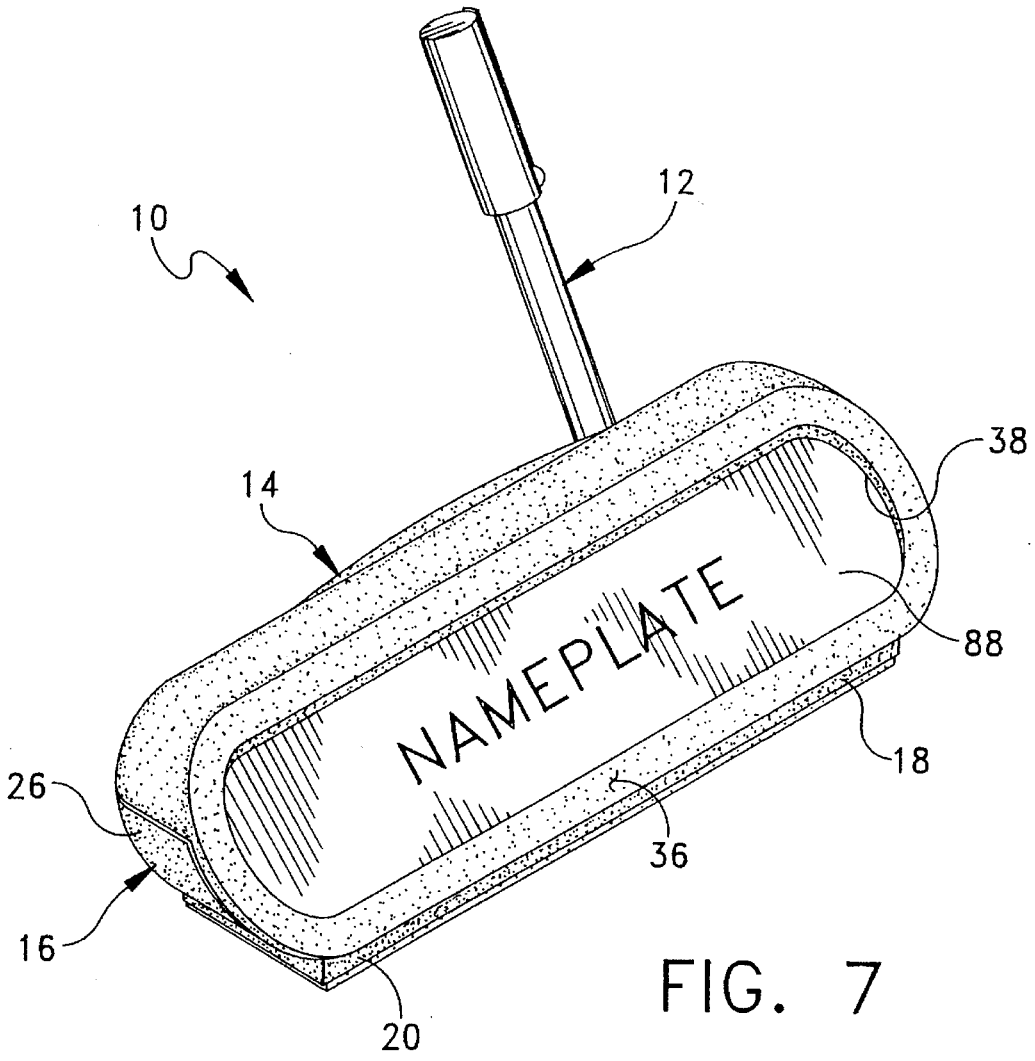
FIG. 7 is a perspective view of the convertible display case and desk organizer similar to FIG. 5 with the top section being illustrated in a closed position.

In its illustrated display case mode of FIG. 1, the viewing opening 38 is covered by an elongate, transparent window 44 which is releasably attached to the top section 14 in a suitable manner, e.g., by resilient members 46, 48 (FIG. 6). The transparent window 44 protects the writing instrument which is located inside while allowing it to be viewed through the opening 38.

The top and bottom sections 14, 16 each have latch elements 50, 52 which are releasably interengageable with one another for maintaining the top and bottom sections 14, 16 in their closed position. More specifically, the latch element 52 of the bottom section 16 is fixed and the latch element 50 of the top section 14 is moveable in such a manner that, when the top and bottom sections 14, 16 are in their closed position, the top latch element 50 is biased to engage the bottom latch element 52 for maintaining the sections in their closed position. As illustrated, a push button 54 is provided for moving the top latch element away from the bottom latch element when it is desired to open the display case by pivotally moving the bottom and top sections to their open position.

Figure 2:
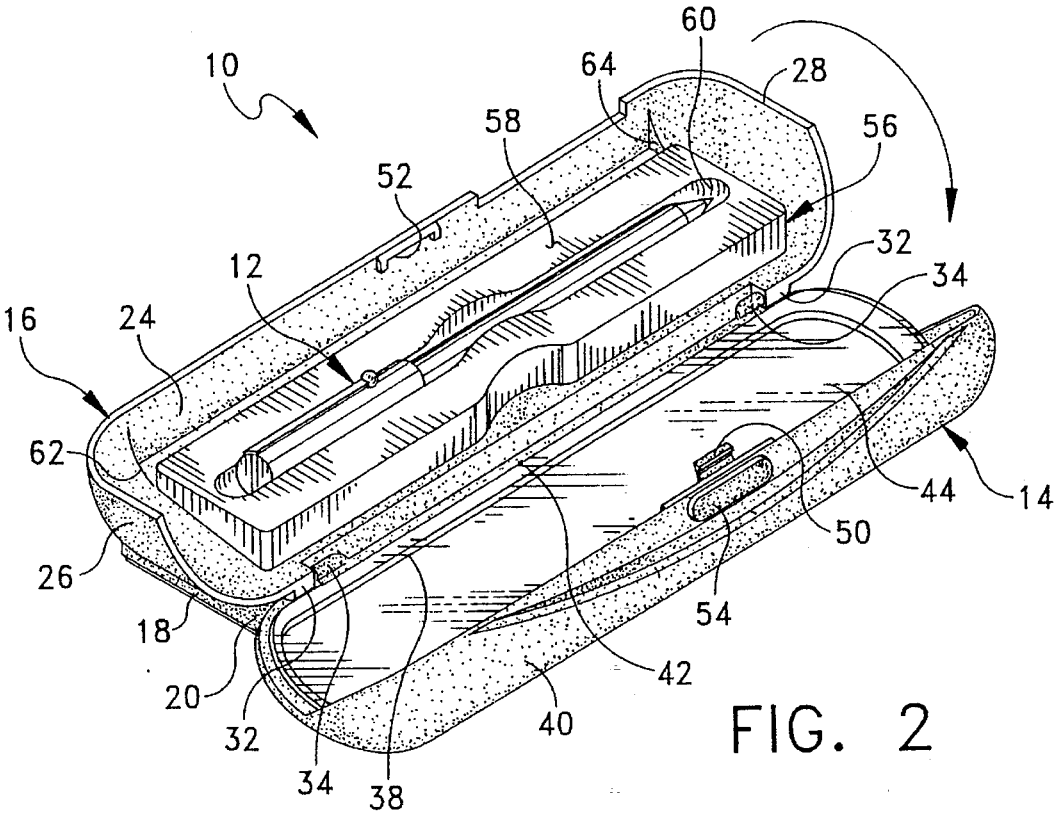
FIG. 2 is a view similar to FIG. 1 with the top section of the convertible display case and desk organizer being pivoted about a hinge to an open position.
Figure 3:
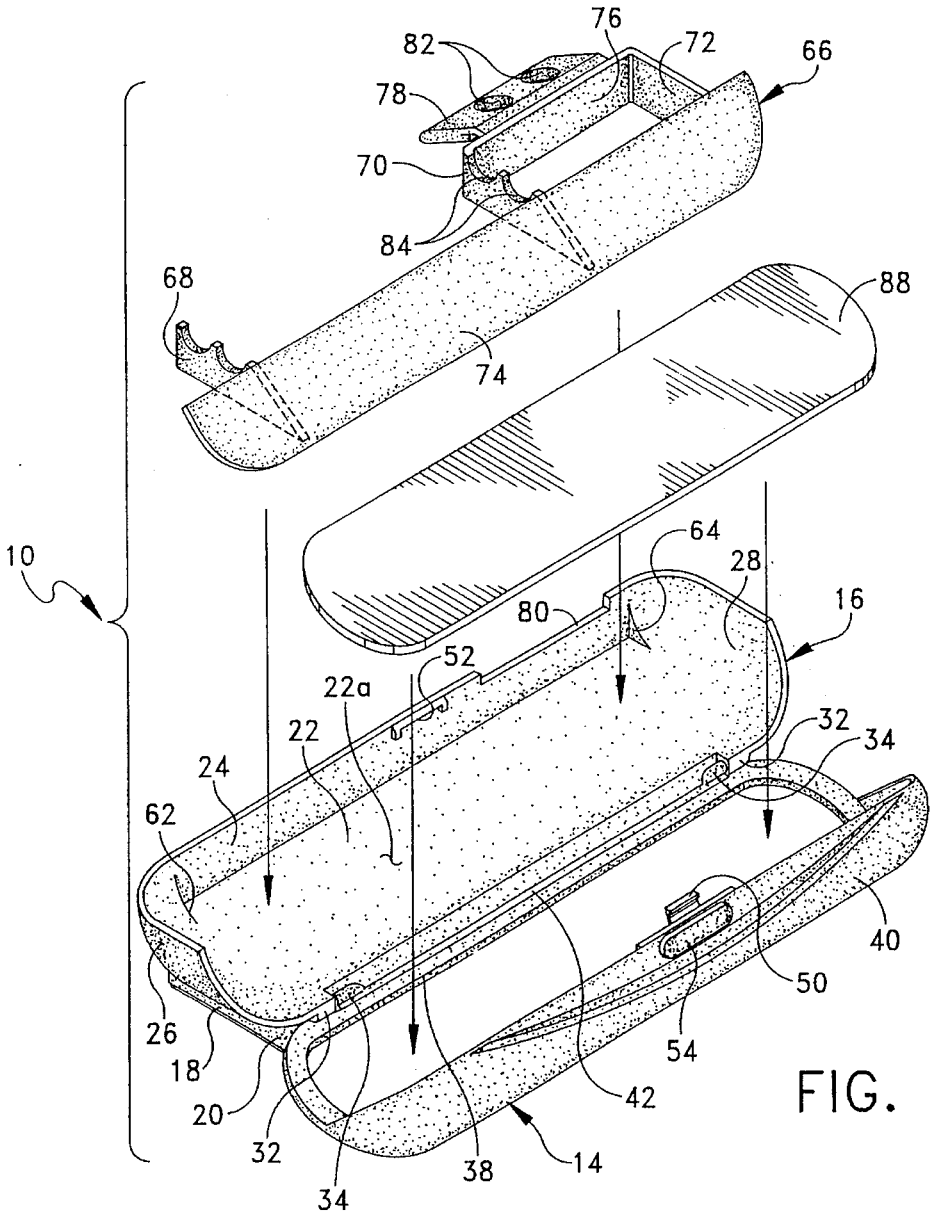
FIG. 3 is an exploded perspective view of the convertible display case and desk organizer as it is being converted to its desk organizer mode with a second insert and a name plate of the desk organizer replacing a first insert and clear window of the display case.
Figure 4:
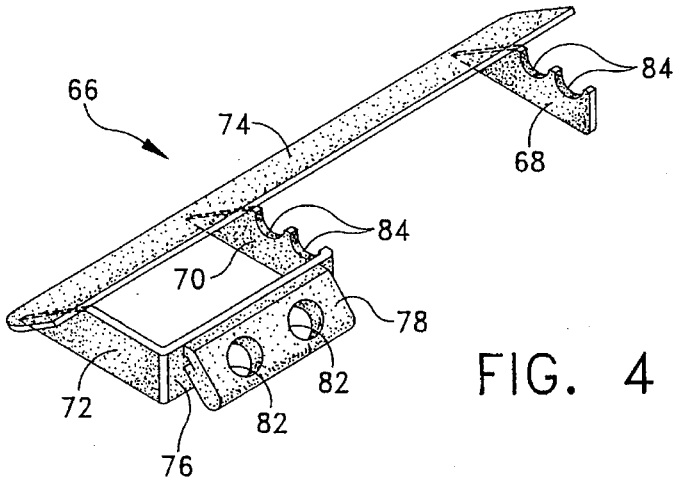
FIG. 4 is a perspective view of the second insert of the desk organizer.

A first insert, generally indicated at 56 in FIGS. 1 and 2, is releasably placed in the bottom section 16 when the convertible display case and desk organizer 10 is to be used as a display case. As shown, the first insert 56 is sized to fit within the bottom section 16 wherein it rests upon the upwardly facing surface 22 of the bottom section 16. The first insert 56 has an upper surface 58 and an elongate recess 60 formed in the upper surface 58, the recess 60 being sized to releasably secure the writing instrument 12 therein in a conventional fashion. It should be understood that first insert 56 may be provided with two recesses for releasably securing a pen and pencil set, for example. Two spaced-apart vertical wall portions 62, 64 are formed in the bottom section 16 to limit the lateral movement of the first insert 56 when it is placed in the bottom section 16. The first insert is preferably made by a conventional vacuum forming process.

Thus far, the convertible display case and desk organizer 10 of the present invention is suited for displaying and storing writing instruments 12. The display case 10 is suitable for displaying the writing instrument at point of sale, such as being placed on a shelf or within a larger display case, and for storage/travel purposes wherein the display case protects the writing instrument 12. Even when the display case 10 is closed, the writing instrument 12 may be viewed through the transparent window 44.

A second insert, generally indicated at 66 in FIGS. 3–6, is provided for converting the display case 10 to a desk organizer mode. As with the first insert 56, the second insert 66 is releasably placed on the surface 22 of the bottom section 16 after the first insert 56 is removed. The second insert 66 includes three spaced-apart, vertical walls 68, 70 and 72 oriented in parallel relation, an elongate wall 74 which extends perpendicularly with respect to and connects the three vertical walls 68, 70 and 72, and another wall 76 which interconnects the second and third walls 70, 72. The first and third walls 68, 72 engage the two spaced-apart vertical wall portions 62, 64, respectively, to limit the lateral movement of the second insert 66 when it is placed in the bottom section 16.

Figure 5:
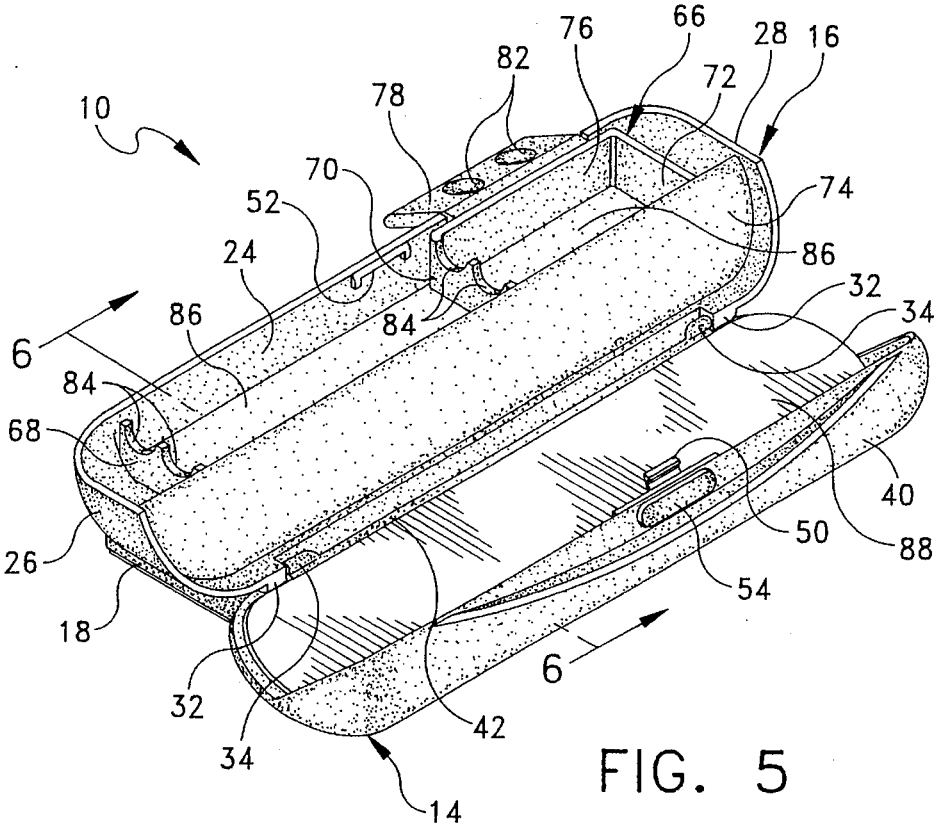
FIG. 5 is perspective view of the convertible display case and desk organizer in its desk organizer mode with the top section in its open position.

Wall 76 is provided with an outwardly extending portion 78 which extends outwardly beyond the edge of the top and bottom sections 14, 16 as illustrated in FIGS. 5 and 6. As illustrated best in FIG. 3, the bottom section 16 has material removed from the edge of the side wall at 80 to define an elongate slot which receives outwardly extending portion 78, the portion 78 being downwardly sloping and having two apertures 82 formed therein for receiving a writing instrument in a substantially upright position.

The first and second walls 68, 70 define support means on which additional writing instruments can be stored within the case. As illustrated, the first and second walls 68, 70 have aligned upwardly opening notches 84 for receiving writing instruments in a conventional manner. The spaces between the first and second walls and the second and third walls define compartments 86 which can receive and store other articles, such as paper clips, erasers, pencil lead, or the like therein.

In its desk organizer mode, the viewing opening 38 of the top section 14 can alternatively be covered by an elongate plate 88 which is releasably attached to the top section 14 by the resilient members 46, 48. The plate 88 may carry the name of the owner of the convertible display case and desk organizer 10, or any other information or indicia.

It should be observed that the convertible display case and desk organizer 10 of the present invention in its display case mode is adapted to display and store writing instruments 12, and in its desk organizer mode is adapted to be used to secure the writing instrument in a substantially upright position and store other items, such as other writing instruments or paper clips, as well. The convertible display case and desk organizer 10 is also capable of displaying the writing instrument 12 through the viewing opening 38 which is covered by the transparent window 44 in its display case mode, or function as a name plate holder in its desk organizer mode.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A convertible display case and desk organizer comprising:

hingedly connected top and bottom sections pivotable with respect to one another between a closed position and an open position;

a first insert adapted to be releasably placed in the bottom section, said first insert being adapted to releasably receive an article, such as a writing instrument, the arrangement being such that, when said first insert is disposed within the bottom section, the top and bottom sections and first insert assume a display case mode;

a second insert adapted to be releasably placed in the bottom section when the first insert is removed therefrom, said second insert having an outwardly extending portion which extends outwardly beyond the edge of the top and bottom sections when they are in their closed position, said outwardly extending portion having at least one aperture formed therein for receiving an article, such as a writing instrument in a substantially upright position, the arrangement being such that, when said second insert is disposed within the bottom section, the top and bottom sections and the second insert assume a desk organizer mode.

2. A convertible display case and desk organizer as set forth in claim 1, said top section having an elongate viewing opening formed therein along the length of the top section for viewing the article when the top and bottom sections are in their closed position.

3. A convertible display case and desk organizer as set forth in claim 2, said viewing opening being covered by an elongate, transparent window releasably attached to the top section, said transparent window protecting said article while allowing the article to be viewed when it is in its display case mode.

4. A convertible display case and desk organizer as set forth in claim 3, said viewing opening being covered by an elongate plate releasably attached to the top section, said plate carrying information or any other indicia thereon when it is in its desk organizer mode.

5. A convertible display case and desk organizer as set forth in claim 2, said top section having a downwardly sloping surface, said viewing opening being formed in said downwardly sloping surface.

6. A convertible display case and desk organizer as set forth in claim 1, said second insert having support means on which additional articles can be stored within the case when it is in its desk organizer mode.

7. A convertible display case and desk organizer as set forth in claim 6, said support means comprising at lease two spaced-apart vertical walls having aligned upwardly opening notches for receiving said articles, said walls defining separate compartments which are adapted to store other articles, such as paper clips and the like.

8. A convertible display case and desk organizer as set forth in claim 1, one of said top and bottom sections having material removed from an edge thereof to define an elongate slot when the convertible display case and desk organizer is in its closed position, said outwardly extending portion extending through the slot.

* * * * *